US007240468B2

(12) United States Patent
Tanaka et al.

(10) Patent No.: US 7,240,468 B2
(45) Date of Patent: Jul. 10, 2007

(54) METHOD AND SYSTEM FOR PRODUCING SHOCK ABSORBING PACKAGE CONTAINING PACKAGED ARTICLE

(75) Inventors: Mikio Tanaka, Osaka (JP); Daisuke Uratani, Tokyo (JP); Shuji Uda, Toyama (JP)

(73) Assignee: Sun A. Kaken Co., Ltd., Tokyo (JP)

( * ) Notice: Subject to any disclaimer, the term of this patent is extended or adjusted under 35 U.S.C. 154(b) by 0 days.

(21) Appl. No.: 10/483,490

(22) PCT Filed: May 29, 2003

(86) PCT No.: PCT/JP03/06723

§ 371 (c)(1),
(2), (4) Date: Jan. 13, 2004

(87) PCT Pub. No.: WO2004/022432

PCT Pub. Date: Mar. 18, 2004

(65) Prior Publication Data

US 2004/0216429 A1 Nov. 4, 2004

(30) Foreign Application Priority Data

Sep. 4, 2002 (JP) ..... 2002-259398

(51) Int. Cl.
*B65B 43/04* (2006.01)
*B65B 55/00* (2006.01)

(52) U.S. Cl. ..... 53/455; 53/79; 53/95; 53/115; 53/403; 53/562

(58) Field of Classification Search ..... 53/403, 53/432, 433, 434, 115, 79, 95, 559, 562, 455
See application file for complete search history.

(56) References Cited

U.S. PATENT DOCUMENTS 3,340,669 A * 9/1967 Farquharson ..... 53/455
4,545,844 A * 10/1985 Buchanan ..... 156/515
4,793,123 A * 12/1988 Pharo ..... 53/449
4,949,530 A * 8/1990 Pharo ..... 53/449
5,001,884 A * 3/1991 Hanagata ..... 53/58

(Continued)

FOREIGN PATENT DOCUMENTS

JP 5-201427 A 8/1993

(Continued)

*Primary Examiner*—Christopher R. Harmon
(74) *Attorney, Agent, or Firm*—Birch, Stewart, Kolasch & Birch, LLP

(57) ABSTRACT

A method and apparatus for manufacturing a cushioning package containing an article to be packaged. The apparatus includes a cushioning sheet forming unit to form a cushioning sheet by heat-sealing flexible elongated resin sheets which are continuously fed in a longitudinal direction and placed one on another in advance in a width direction of the sheet, the cushioning sheet including small sacs. Downstream from the cushioning sheet forming unit, an article storage space forming unit is provided for forming an article storage space by folding the cushioning sheet along a longitudinal centerline. A sheet adhering unit adheres the overlapped cushioning sheets. An article disposing unit inserts the article to be packaged into the article storage space, and an air filling unit fills the small sacs with air. Sequential performance of the above steps achieves efficient manufacturing of cushioning package.

10 Claims, 12 Drawing Sheets

U.S. PATENT DOCUMENTS 5,263,587 A * 11/1993 Elkin et al. ..... 206/522
5,272,856 A * 12/1993 Pharo ..... 53/472
5,337,539 A * 8/1994 Barton ..... 53/413
5,427,830 A * 6/1995 Pharo ..... 428/35.2
5,445,271 A * 8/1995 Kakizaki et al. ..... 206/459.5
5,454,642 A * 10/1995 De Luca ..... 383/3
5,487,470 A * 1/1996 Pharo ..... 206/522
5,941,052 A * 8/1999 Evangelisti ..... 53/433
6,116,000 A * 9/2000 Perkins et al. ..... 53/472
6,213,167 B1 * 4/2001 Greenland ..... 141/10
6,283,296 B1 * 9/2001 Newman ..... 206/522
6,569,283 B1 * 5/2003 Sperry et al. ..... 156/583.2
6,571,954 B2 * 6/2003 Nadler ..... 206/522
2003/0139271 A1 * 7/2003 Vangedal-Nielsen et al. .... 493/162

FOREIGN PATENT DOCUMENTS

JP 3009233 U 1/1995
JP 2002-154579 A 5/2002
JP 2002-255246 A 9/2003

* cited by examiner

PRIOR ART

METHOD AND SYSTEM FOR PRODUCING SHOCK ABSORBING PACKAGE CONTAINING PACKAGED ARTICLE

TECHNICAL FIELD

The present invention relates to a method of manufacturing a cushioning package containing an article to be packaged and to a manufacturing apparatus thereof.

BACKGROUND ART

Conventionally, cushioning packages with a cushioning sheet being able to be filled with air have often been used in order to package an article, such as electrical appliances and parts for machines, which needs to be protected.

For example, FIG. 12 shows a cushioning package 101 that is described by the Official Gazette of Japanese Utility Model Registration No. 3009233. This is a cushioning package having an article storage space 103 sandwiched by a cushioning sheet that is composed of a plurality of small sacs 102, and the packaged article 104 disposed in the article storage space 103 is protected by the small sacs 102 filled with air.

The above-mentioned cushioning package 101 is, however, one wherein the small sacs 102 are filled with air after the article 104 to be packaged has been contained, and because manufacturing of the cushioning package 101 itself, containing of the article 104 and filling the small sacs 102 with air cannot be performed at the same time, a complicated process has been required in order to manufacture a cushioning package containing an article to be packaged therein.

Thus, the present invention aims to provide a method of manufacturing a cushioning package containing an article to be packaged and a manufacturing apparatus thereof, which can achieve simultaneous manufacturing of the cushioning package, containing of an article to be packaged and filling the package with air.

DISCLOSURE OF THE INVENTION

In order to solve the above problem, a first aspect of the present invention provides a method of manufacturing a cushioning package containing an article to be packaged. The method comprises the following steps. A first step is to form a cushioning sheet 1 by heat-sealing flexible elongated sheets 10 which are continuously fed in a longitudinal direction and placed one on another in advance in a width direction of the sheet, which includes small sacs 11 with an air-filling inlet portion 11*a* at least at one end thereof. A second step, which is a sequential step to said first one, is to form an article storage space 1*c* enveloped by the small sacs 11 by folding and adhering edges of the cushioning sheet 1 folded along the longitudinal direction of the sheet 1, except for a portion that becomes an article storage opening 1*d*. A third step is to dispose an article C to be packaged in the article storage space 1*c* through the article storage opening 1*d* that serves as an entry portion of the article storage space 1*c*. And a fourth step is to close the article storage opening 1*d* and the inlet portion 11*a* of the small sac 11 by adhesion while filling air to inflate the small sacs 11. The above steps are performed in the recited order.

Sequential performance of the above steps achieves efficient manufacturing of cushioning package containing an article to be packaged.

It should be noted that performing the first step and the second step "continuously" means that the cushioning sheet

1 is fed to the second step without being cut after the first step. As a natural concept, this includes a case where no other mechanism intervenes between the first step and the second step or a case where another mechanism intervenes such as a mechanism that performs other additional processing with respect to the cushioning sheet 1 processed by the first step or a mechanism that temporarily detains the cushioning sheet 1.

In a second aspect of the present invention, as for the above first aspect, the method of manufacturing a cushioning package containing an article to be packaged comprises the first step to form a plurality of bottom seals 12 in the width direction of the end portions of the overlapped sheets, thereby forming a plurality of small sacs 11 extending in the width direction of the sheet. At the inlet portions 11*a* of the small sacs 11 are provided resistance seals 13 for imparting resistance to the flowing air. As for the above second step, it includes a step to fold the cushioning sheet 1 in the longitudinal direction and a step to adhere the edges of the folded cushioning sheet 1 except for a portion that serves as an article storage opening 1*d*.

As described above, provision of resistance seals 13 at the inlet portions 11*a* of the small sacs 11 produces resistance against the airflow through the small sac inlet portion 11*a* and avoid immediate air leaking out of the small sacs 11 in filling air, enabling the small sac 11 to be closed with the air filled thereinside.

A third aspect of the present invention provides an apparatus for manufacturing a cushioning package containing an article to be packaged. The apparatus comprises the following units. A cushioning sheet forming unit 8 is to form a cushioning sheet 1 by heat-sealing flexible elongated resin sheets 10 which are continuously fed in a longitudinal direction and placed one on another and advance in a width direction of the sheet, which includes small sacs 11 with an air-filling inlet portion 1*a* at least at one end thereof. An article storage space forming unit 3, which is a sequential unit to said cushioning sheet forming unit, is to form an article storage space 1*c* by placing the cushioning sheet 1 on another. A sheet adhering unit 4 is to adhere the overlapped cushioning sheets 1. An article disposing unit 5 is to dispose an article C to be packaged in the article storage space 1*c*. And an air filling unit 6 is to fill the small sacs 11 with air.

As described above, flexible elongated resin sheets 10 pass a series of units, being processed into a cushioning package containing an article to be packaged, facilitating manufacturing of cushioning package containing an article to be packaged.

A fourth aspect of the present invention, as for the above third aspect, provides the apparatus for manufacturing a cushioning package containing an article to be packaged, wherein said sheet adhering unit 4 includes a longitudinal-direction seal section 41 for adhering the longitudinal direction of the cushioning sheet 1, a width-direction seal section 42 for adhering the width direction, and a small sac closing seal section 43 for adhering the cushioning sheet 1 at the inlet portions 11*a* of the small sacs 11. The longitudinal-direction seal section 41 forms an air passage 15 that communicates with the small sacs 11 in the cushioning sheet 1. Said air filling unit 6 includes an air nozzle 61 which tip of an air discharge portion 61*a* is disposed inside the air passage 15, and reverse-flow prevention member 62 for directing the airflow inside the air passage 15 to the small sacs 11 by pressing the air passage 15. The width-direction seal section 42 and the reverse-flow prevention member 62 are formed on a moving body M. The moving body M is movable along the longitudinal direction of the cushioning sheet 1 depending on the size of the article C to be packaged. After filling of the small sacs 11 with air discharged from the air nozzle 61, the moving body M is moved downstream together with the cushioning sheet 1 before the width-direction seal section 42 adheres the cushioning sheet 1 and the small sac closing seal section 43 closes the inlet portions 11*a* of the small sacs 11, to complete the cushioning package containing the article.

As described above, the movement of the moving body M having the width-direction seal section 42 and the reverse-flow prevention member 62 assists in filling the small sacs 11 with air, facilitating manufacturing of cushioning package containing an article to be packaged.

A fifth aspect of the present invention, as for the above fourth aspect, provides the apparatus for manufacturing a cushioning package containing an article to be packaged, wherein the reverse-flow prevention member 62 is provided at its tip 62*b* with a recess 62*a* that conforms in shape with the cross-sectional shape of the air nozzle 61*a*. The tip 62*b* presses the air passage 15 in a state that the tip 62*b* positioned in the air passage 15 is disposed in the recess 62*a*, thereby closing the air passage 15 except for the portion where the air nozzle 61 is disposed.

As described above, press of the tip 62*b* of the reverse-flow prevention member 62 on the air passage 15 ensures that the air supplied from the air nozzle 61 fills the small sacs 11.

A sixth aspect of the present invention, as for the above fourth or fifth aspect, provides the apparatus for manufacturing a cushioning package containing an article to be packaged, wherein the air filling unit 6 includes an adjusting nozzle 63, the tip of which is disposed in the article storage space 1*c*. The adjusting nozzle 63 includes means for adjusting the internal pressure of the article storage space 1*c*. Said means is capable of sucking out the air in the article storage space 1*c* or of filling gases such as air or an inert gas into the article storage space 1*c*.

As described above, the internal pressure of the article storage space 1*c* is adjusted by the adjusting nozzle 63 under a positive pressure or a negative pressure in comparison with the outside thereof, thereby being able to manufacturing a cushioning package best suited for use intended such as prevention of insufficient air-filling of the small sacs 11, quality preservation of the packaged article C and improvement of total cushioning effect of the cushioning package.

BEST MODE OF THE INVENTION

Figure 1:
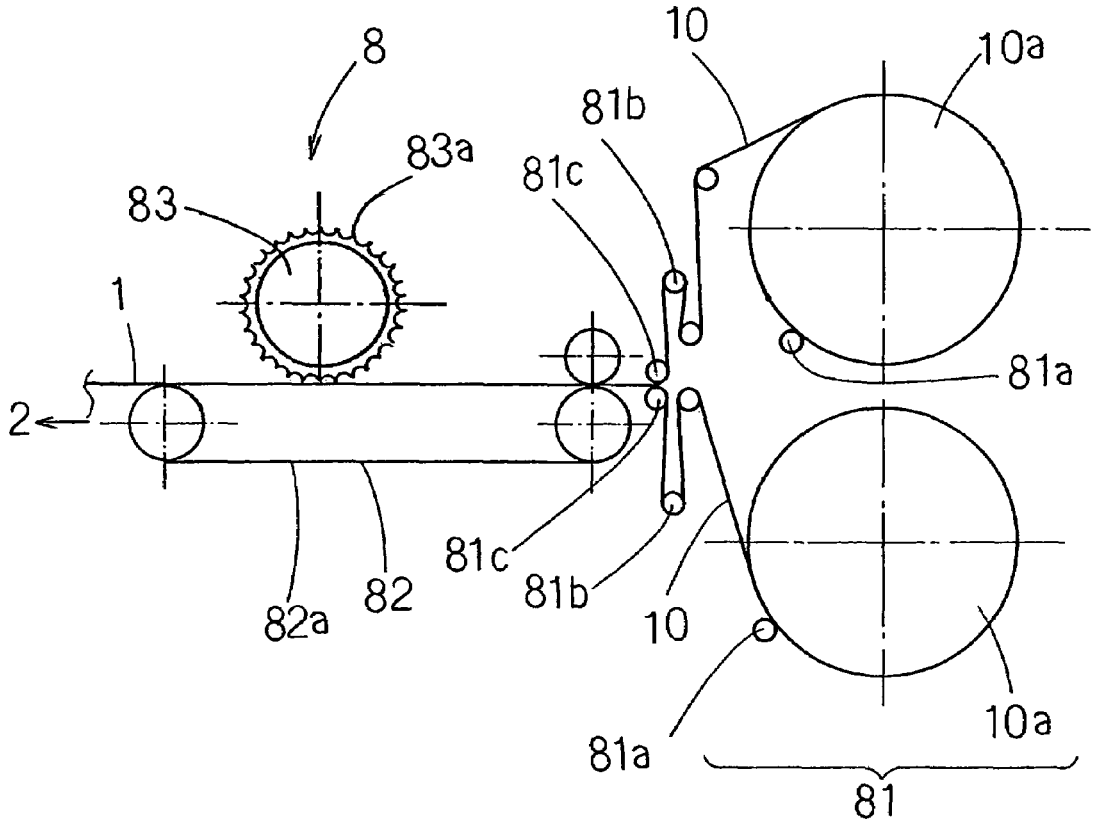
FIG. 1 is an explanatory view showing a cushioning sheet forming unit in a manufacturing apparatus according to an example of an embodiment of the present invention.
Figure 2:
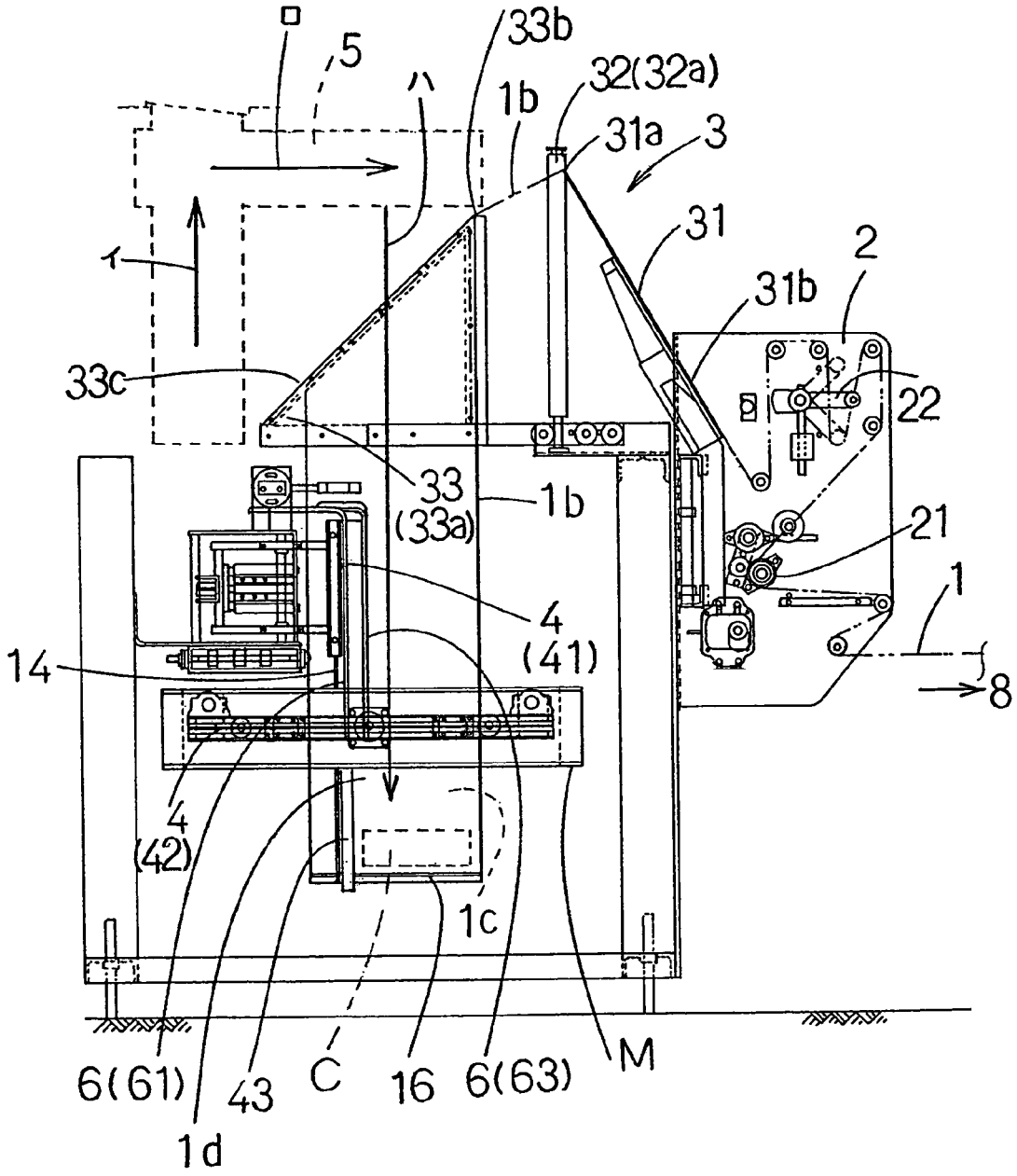
FIG. 2 is an explanatory view showing a sheet feeding adjustment unit, an article storage space forming unit, a sheet adhering unit and an air filling unit in the manufacturing apparatus, with an article disposing unit excluded therefrom.
Figure 6:
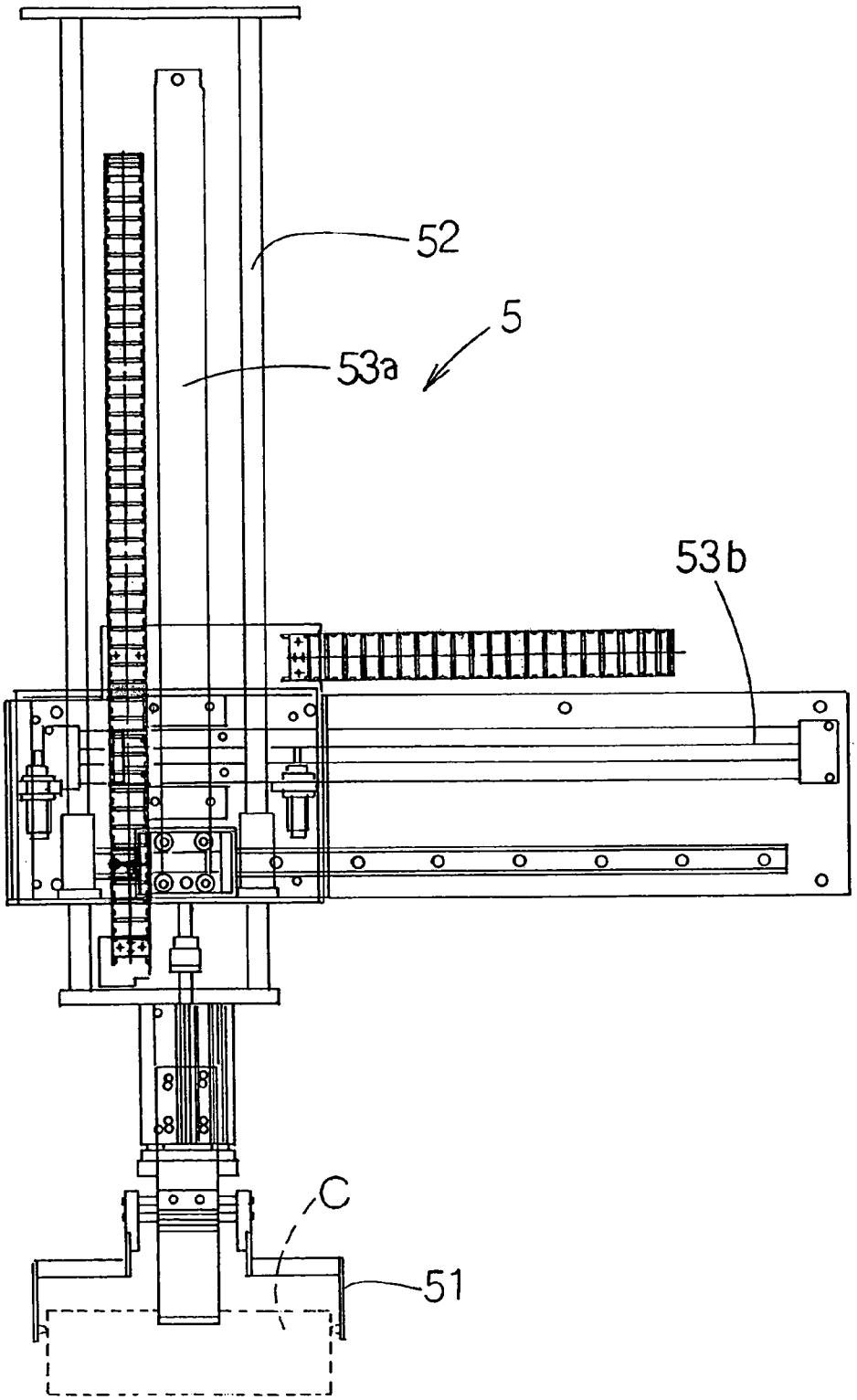
FIG. 6 is an explanatory view of the article disposing unit from its front.
Figure 7:
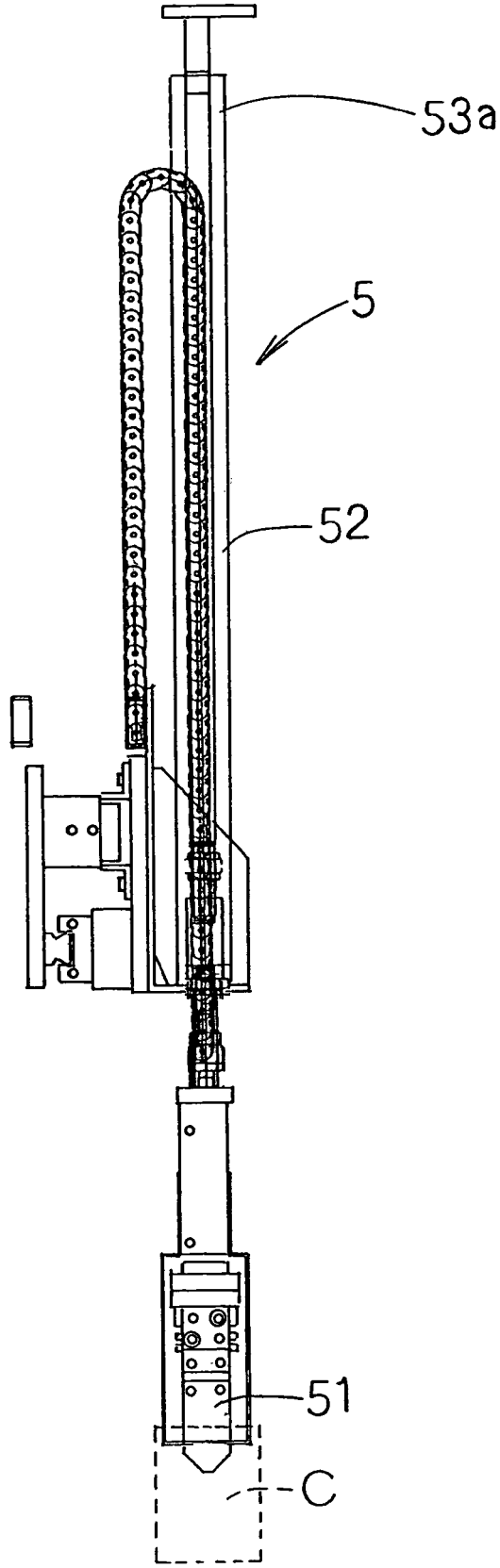
FIG. 7 is an explanatory view of the same from its left side.
Figure 8:
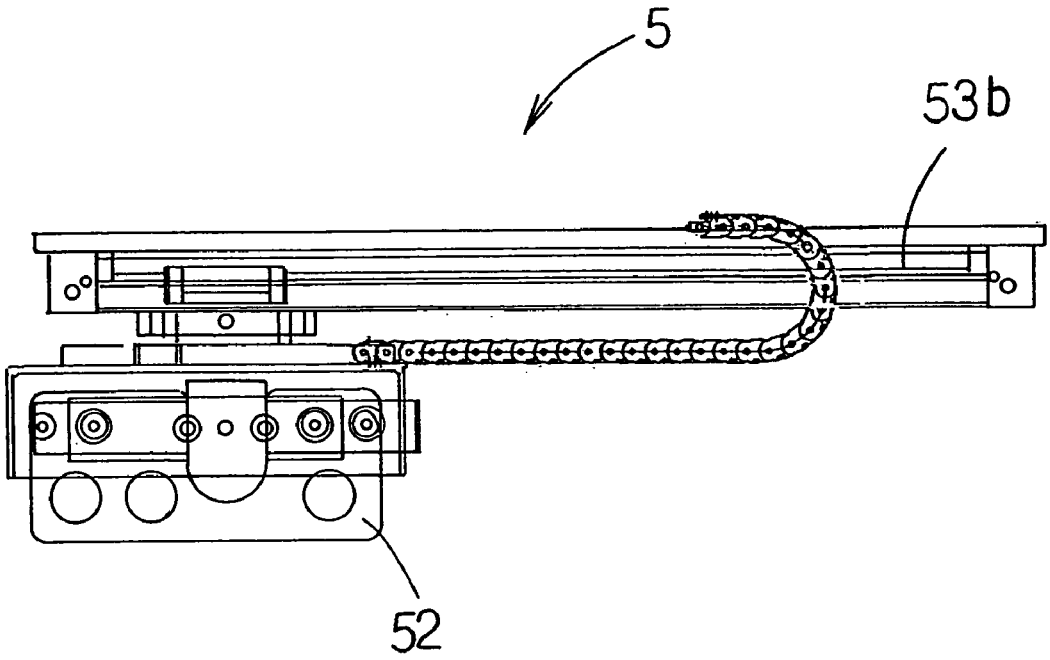
FIG. 8 is an explanatory view of the same from its plan.

An apparatus for manufacturing a cushioning package containing an article to be packaged will now be described with reference to the drawings as an example of an embodiment of the present invention. FIG. 1 is an explanatory view showing a cushioning sheet forming unit in the manufacturing apparatus of the present example. FIG. 2 is an explanatory view showing a sheet feeding adjustment unit, an article storage space forming unit, a sheet adhering unit and an air filling unit in the manufacturing apparatus of the present example, with an article disposing unit excluded therefrom. FIGS. 6 to 8 are explanatory views showing the article disposing unit.

The manufacturing apparatus of the present example processes elongated master sheets 10 to form a cushioning sheet 1 including small sacs 11 and wrap an article C to be packaged while filling the small sacs 11 with air, thereby manufacturing a cushioning package containing an article to be packaged.

The manufacturing apparatus of the present example comprises a cushioning sheet forming unit 8 shown in FIG. 1, a sheet feeding adjustment unit 2, an article storage space forming unit 3, a sheet adhering unit 4, an article disposing unit 5 and an air filling unit 6 shown, all shown in FIG. 2.

Next, each of said units will be described. It should be noted that, although the following explanation will be given in an order of steps in the manufacturing apparatus of the present example, the order of the steps in the present invention should not be construed as being limited to the order of the present example and can be appropriately interchanged and implemented within a possible range. Also, some of the steps may be omitted depending on the case.

As shown in FIG. 1, the cushioning sheet forming unit 8, which comprises a roll feeding unit 81, a conveyance unit 82 and a bottom seal forming unit 83, forms a cushioning sheet 1 including small sacs 11 by heat-sealing the master sheets 10.

The roll feeding unit 81 continuously feeds in a longitudinal direction of the elongated master sheets 10 with a constant width dimension. In the present example, a flexible thermoplastic resin sheet such as polyethylene or nylon is used as a material for master sheets 10. Although a transparent sheet is used for a master sheets 10 here, tinted, translucent or opaque one, or one where a notice or advertising copy has been printed beforehand on the surface is also available.

A rotatable shaft (not shown) is disposed in the roll feeding unit 81 to place a cylindrically wound master rolls 10, 10*a*. In the present example, a sheet amount sensor mechanism 81*a* is disposed so as to contact outer periphery of each roll 10*a*. The mechanism detects the diameter of each master roll 10*a*, whereby a time to replace the roll 10*a* is noticed.

As shown, the master rolls 10*a*, 10*a* in the embodiment are separated in the vertical direction to a conveying surface where the master sheets 10 are conveyed in the conveyance unit 82. Arrangement of the master rolls 10, 10*a* is not limited thereto and can be appropriately changed, such as paralleling the rolls in a horizontal direction. It depends on the circumstance such as a place where the cushioning sheet forming unit 8 is disposed.

Each master sheet 10 pulled out of a master roll 10*a* passes through a tension adjustment mechanism 81*b*. The mechanism exerts appropriate tension to prevent looseness of the master sheets 10 by loading them on rollers, each of which is respectively urged in the vertical direction, and places the two tension-exerted sheets 10 one on another by means of feeding rollers 81*c*, and supplies them to the conveyance unit 82. Tension adjustment is also separately effected in the sheet feeding adjustment unit 2 positioned downstream from the conveyance unit 82, so the master sheets 10 do not suffer looseness while being on a conveyor belt 82*a* of the conveyance unit 82 and are properly heat-sealed.

In the conveyance unit 82, the sheets 10 are supported underneath and conveyed by the conveyor belt 82*a* of a flat belt or the like. The bottom seal forming unit 83 described later is positioned above the conveyance unit 82, and a roller of the bottom seal forming unit 83 presses and heat-seals the sheets 10 supported on the conveyor belt 82*a*.

Figure 3:
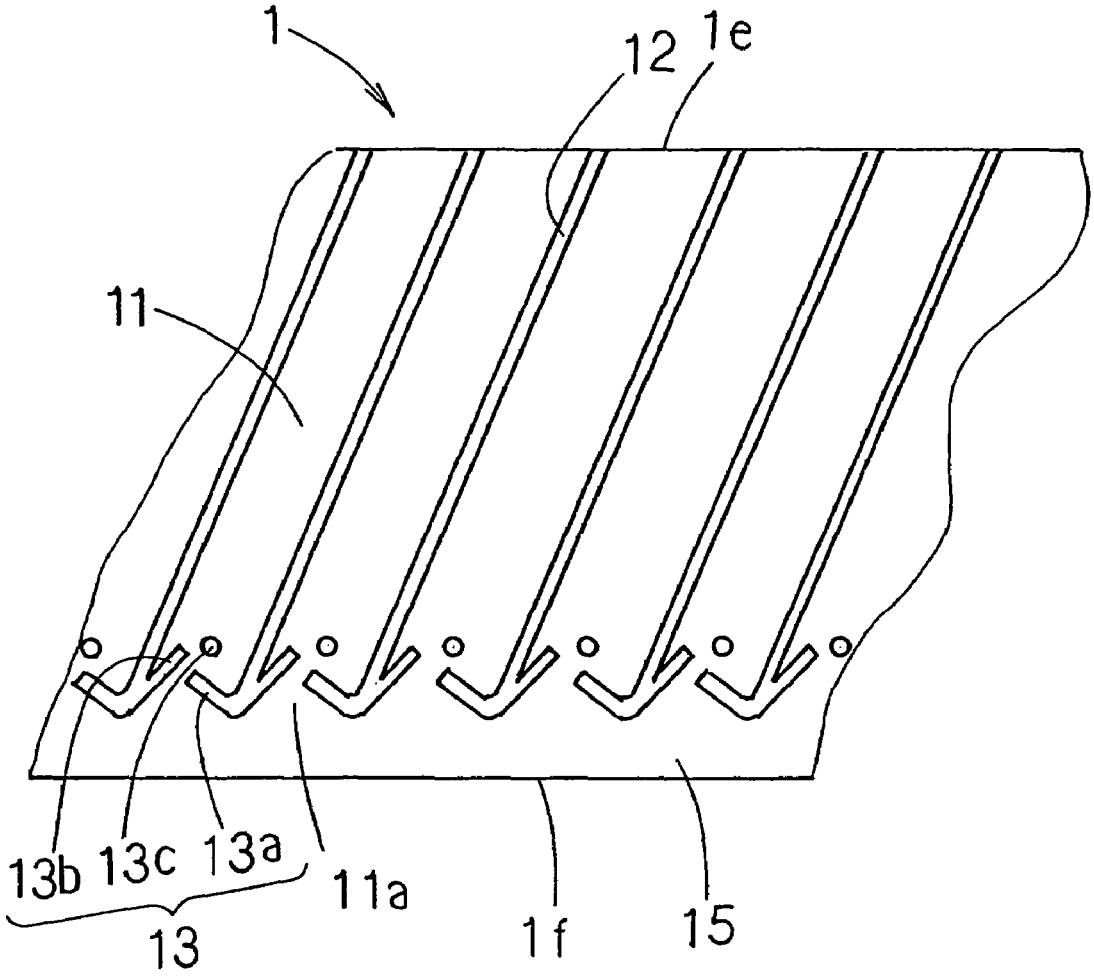
FIG. 3 is an explanatory view showing a cushioning sheet with small sacs formed therein.

The sheets 10 being conveyed in this manner by the conveyance unit 82 subsequently pass through the bottom seal forming unit 83. In the present example, the bottom seal forming unit 83 is a roller having heating protrusions 83*a* on the peripheral surface, as shown in FIG. 1. Heating means such as a heater is provided inside the roller, and conduct heat to the protrusions 83*a*, which are pressed against the overlapped sheets 10 and adhere the sheets 10. Thus, as shown in FIG. 3, individual linear bottom seals 12 are formed across the width of sheets 10. As the bottom seal forming unit 83 rotates the conveyance unit 82 in motion, the bottom seals 12 are sequentially formed in the longitudinal direction of sheets 10 at a constant interval corresponding to the heating protrusions 83*a* of the roller.

A portion between the adjacent bottom seals 12 and spreading like a strip in the width direction becomes a small sac 11. At the time the bottom seals 12 are formed as described above, the small sacs 11 are not closed yet and are at a later stage closed by the sheet adhering unit 4 in a state where the small sacs 11 have been filled with air.

As shown in FIG. 3, one of the ends of each bottom seal 12 is connected to one side end 1*e* along the longitudinal direction of the cushioning sheet 1. The other end of each of the bottom seals 12 is formed so as to keep a constant interval against the other side end if along the longitudinal direction of the cushioning sheet 1. The portion where this interval is maintained becomes an air passage 15 extending in the longitudinal direction as the bottom seal 12 is sequentially formed in the same direction. In other words, as a bottom seals 12 are formed, a small sacs 11 extending in the width direction of the cushioning sheet 1 are formed as though the small sacs branch off from the right-angled air passage 15 that extends in the longitudinal direction of the sheet.

Along with said bottom seals 12, the bottom seal forming unit 83 simultaneously forms seals 13, which are called a resistance seals for the sake of convenience. In the present example shown in FIG. 3, each resistance seal 13 comprises a first seal 13*a* and a second seal 13*b*, both of which are linearly formed and slant to the bottom seals 12, and a third seal 13*c*, which is circularly formed at an inner side of the first seal 13*a* and the second seal 13*b*. Thus, the seals 13*a* to 13*c* narrow down an air passage at each small sac inlet portion 11*a*. The resistance seals 13 being formed in this manner, resistance can be applied to airflow through the small sac inlet portions 11*a* so that the air filled in the small sacs 11 does not leak soon after the small sac 11 have been filled.

The specific shape of each resistance seal 13 is not limited to the shapes in the present example. As long as resistance can be applied to airflow through the small sac inlet portions 11*a*, its shape is changeable, such as one that simply narrows down an air passage at the inlet portions 11*a* or that forms a maze there. It should be noted that the provision of the resistance seal 13 may be omitted in a case where a mechanism such as a pressing plate for pinching the small sac inlet portions 11*a* is disposed in the sheet adhering unit 4 or the air filling unit 6 positioned on the downstream side not to leak the air filled in the small sacs 11.

The bottom seal forming unit 83 is not limited to such a unit in the present example in which a roller is employed to continuously heat-seal the sheets 10. A flat heating plate, for example, which moves vertically against the conveyor belt 82*a* may be employed to press and heat-seal the sheets 10. In this case, however, it is necessary for the master rolls 10, 10*a* to be fed intermittently to the heating plate's operation. If the variance of timing occurs between feeding of the cushioning sheet 1 and operation of the units following the sheet feeding adjustment unit 2, a mechanism for absorbing the intermittent movement of the cushioning sheet 1 should be additionally disposed. This mechanism may be disposed either in the cushioning sheet forming unit 8 or in the sheet feeding adjustment unit 2 on the downstream side.

With respect to the heating protrusions 83*a* of the roller in the bottom seal forming means 83, a detachable type where the protrusions can be attached to change an interval in the circumferential direction to the roller may be applicable so that the intervals to form the bottom seals 12, namely the width of the small sacs 11, can be changed.

In the present example, only the seals 12 and the resistance seals 13 are formed on the sheets 10 in the cushioning sheet forming unit 8. In other words, the two sheets are not heat-sealed on the side end if illustrated in FIG. 3. As temporary adhesion for preventing the two sheets from becoming misaligned or curling, the side end if may be formed with a dot along with the seals 12 and the resistance seal 13.

Also, the shape of the small sacs 11 in the present invention is not limited to a strip form like the present example. It is applicable that a plurality of circular or oval small sac may be formed by changing the shape of the heating protrusions 83*a* of the roller in the bottom seal forming unit 83 and each small sac is interconnected at an air passage. Or it is applicable that the seals 12 may be not formed, and that the cushioning sheet 1 itself makes a layer of air, i.e. one large sac. Furthermore, even if the seals 12 are formed like the present example, the intervals therebetween may be nonuniform, whereby small sacs 11 of different sizes are formed.

That is, it is possible to form or shape the small sacs 11 as long as they can be filled with air thereinside.

The cushioning sheet 1 with the bottom seals 12 and the resistance seals 13 formed by the cushioning sheet forming unit 8 is supplied to the sheet feeding adjustment unit 2 without being cut. As in the present example, it does not matter that no mechanism is situated between the cushioning sheet forming unit 8 and the sheet feeding adjustment unit 81*a* nor is there a requirement for a mechanism that performs additional processing to the cushioning sheet 1 which has been processed by the cushioning sheet forming unit 8, or that temporarily detains the cushioning sheet 1 may be situated.

The mechanism that temporarily detains the cushioning sheet 1 is particularly required in a case where the cushioning sheet forming unit 8 processes the cushioning sheet 1 by continuous feeding, and the sheet feeding unit 2 and the following units process the sheet 1 by intermittent feeding. The cushioning sheet forming unit 8 may also process the cushioning sheet 1 intermittently, as is when the variance of timing for processing occurs between the cushioning sheet forming unit 8 and the sheet feeding unit 2 and the following units.

The sheet feeding adjustment unit 2 pulls out the cushioning sheet 1 which is heat-sealed by the cushioning sheet forming unit 8 and supplies it in a taut state to the article storage space forming unit 3 and the following units. The sheet feeding adjustment unit also has a drive roller 21 and a tension adjusting arm 22, both of which are driven in conjunction with a moving body M, so that the cushioning sheet 1 is pulled out by the length, and the sheet is delivered downstream without loosening on the upstream side.

The article storage space forming unit 3 folds the cushioning sheet 1 and forms an article storage space 1*c* by being enveloped by the folded cushioning sheet 1.

In the present example, the article storage space forming unit 3 includes bending means 31, folding means 32 and reverse bending means 33.

The bending means 31 comprises a central supporting portion 31*a* for supporting a substantial center of the width direction of the cushioning sheet 1 on the downstream side, and a width end supporting portion 31*b* for supporting the vicinity of both ends in the width direction of the cushioning sheet 1 on the upstream side, thereby forming a crease in the substantial center of the width direction of the cushioning sheet 1. Specifically, it is a substantially isosceles-triangular plate seen in plane view, with the vertex (one between equal sides) thereof being the central support portion 31*a* and with the equal sides being the width end supporting portion 31*b*. In this embodiment, the plate is disposed so as to diagonally face upward from the upstream side to the downstream side.

In passing through the bending means 31, the cushioning sheet 1 is bent along the width end supporting portion (each of the equal sides) 31*b*, and consequently given a crease 1*b* on the central supporting portion (the vertex) 31*a* thereof.

The bending means 31 is not limited to a plate as in the present example, and may be a V-shaped rod member only with a vertex and sides of equal length. Moreover, it may support the sheet by the points on the vertex and the vicinity of the ends (not required to be its edge) in the width direction of the cushioning sheet 1. In other words, as long as a crease 1*b* is formed in the substantial center of the cushioning sheet 1 and the sheet 1 is bent and supported around the width ends not to cause trouble by the curling sheet 1 and affect the following steps, alternatives to the configuration are acceptable.

The folding means 32, a set of two pieces and disposed next on the downstream side to the central supporting portion 31*a* of the bending means 31, folds the cushioning sheet 1 along the crease 1*b*, which is formed as described above, by rollers 32*a*, 32*a* for guiding and holding the sheet 1 therebetween.

In the present example, the rollers 32*a*, 32*a* are vertically placed as shown in FIG. 1, because the crease 1*b* is formed top and both side ends are down of the sheet 1 as the bending means 31 bends the sheet 1.

The reverse folding means 33 comprises a middle-part supporting portion 33*b* for supporting the middle of the cushioning sheet 1 on the upstream side, and a width end supporting portion 33*c* for supporting the vicinity of the ends in the width direction of the cushioning sheet 1 on the downstream side, thereby forming an article storage space 1*c* by folding the sheet 1, which has been folded by the folding means 32, inside out so as to envelop the space.

As shown in FIG. 2, after the cushioning sheet 1 placed right and down in the figure passes through the bending means 31 and folding means 32, both of which are disposed above from the position of the sheet 1 in the figure, the sheet 1 faces transversely. The reverse folding means 33 in the present example is provided in order to turn the transverse-facing cushioning sheet 1 to face axially, and to easily put an article C to be packaged in the article storage space 1*c* in the sheet 1 in consideration of a layout of the manufacturing apparatus. The means, however, may be omitted. In case the reverse folding means 33 is omitted, a configuration of space enveloped by the folded cushioning sheet 1 after passing through the folding means 32 becomes an article storage space 1*c*.

Figure 4:
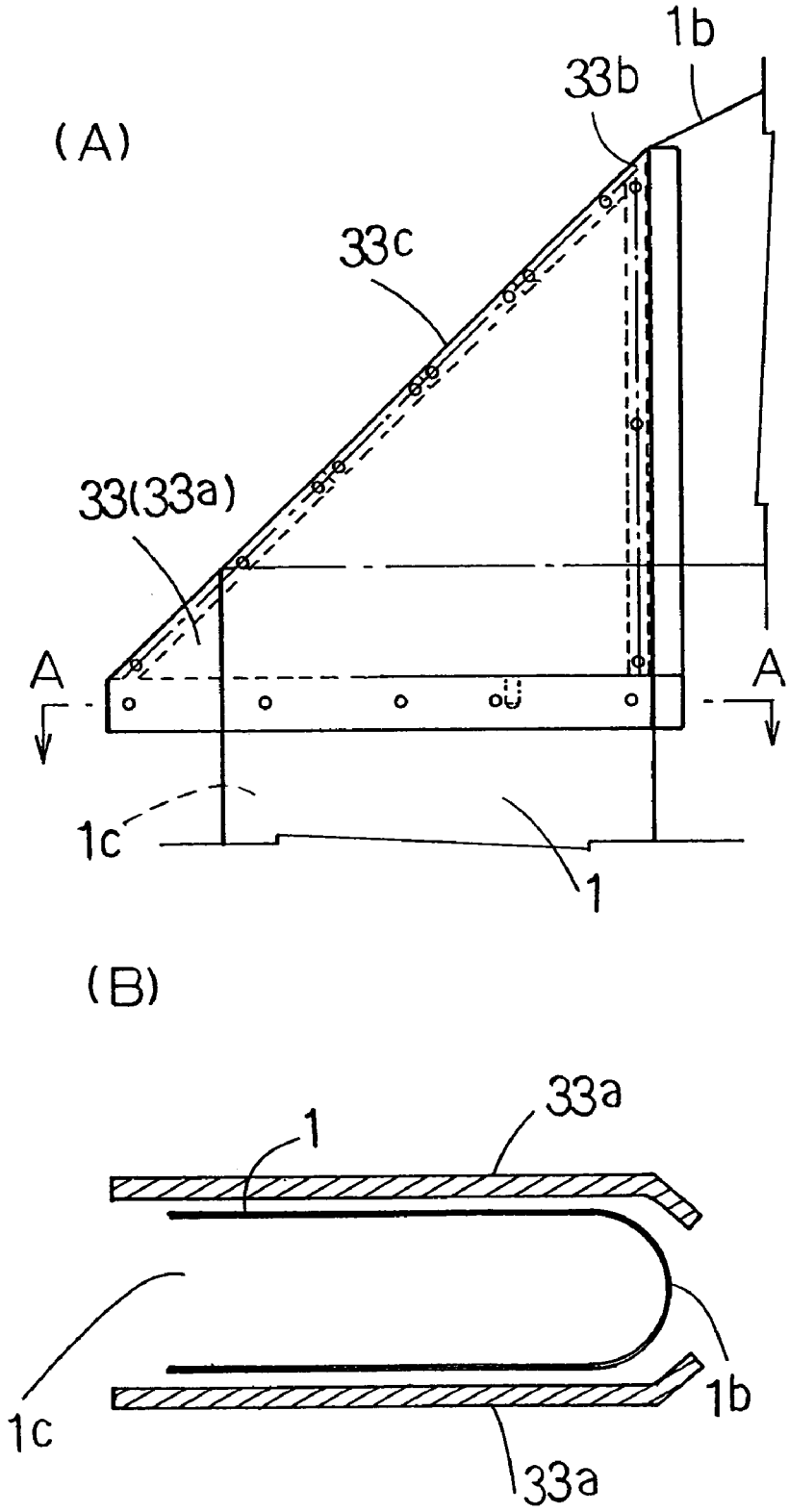
FIG. 4(A) is a major part enlarged explanatory view showing reverse folding means in the article storage space forming unit.
FIG. 4(B) is an A—A cross-sectional view of FIG. 4(A).

As shown in FIG. 4(B), a specific structure of the reverse folding means 33 in the present example comprises parallel plates 33*a*, 33*a* between which the cushioning sheet 1 moves. A substantial right-angle isosceles triangle plate in side view is used for the plate 33*a*. The hypotenuse of the triangle serves as the width end supporting portion 33*c* of the plate 33*a*, and, as shown in FIGS. 2 and 4(A), is placed to make the downstream side underneath. Also, one of the vertexes in a high portion of the hypotenuse 33*c* is the middle-part supporting portions 33*b*.

The cushioning sheet 1 with the crease 1*b* positioned upward is placed on the opposing plates 33*a* along the hypotenuse 33*c*. As the sheet 1 moves downward in a manner that the cushioning sheet 1 falls between the plates 33*a*, 33*a*, the crease 1*b* is inverted and the sheet 1 turns inside out.

In this manner, as shown in FIG. 4(B), the cushioning sheet 1 makes a U-shape as following the plates 33*a*, 33*a*, and the space enveloped by the cushioning sheet 1 becomes the article storage space 1*c*.

Here, as the interval between the plates 33*a*, 33*a* of the reverse folding means 33 or the installation position (the left and right directions in FIG. 2) thereof in the manufacturing apparatus are changeable by fastening with bolts and nuts, the dimensions of bag can change, and alternative types of a cushioning bag can be produced by a single manufacturing apparatus.

The sheet adhering unit 4 adheres the cushioning sheet 1 which is merely folded by the above article storage space forming unit 3 in order to envelop an article C to be packaged by heat-sealing or the like.

Figure 5:
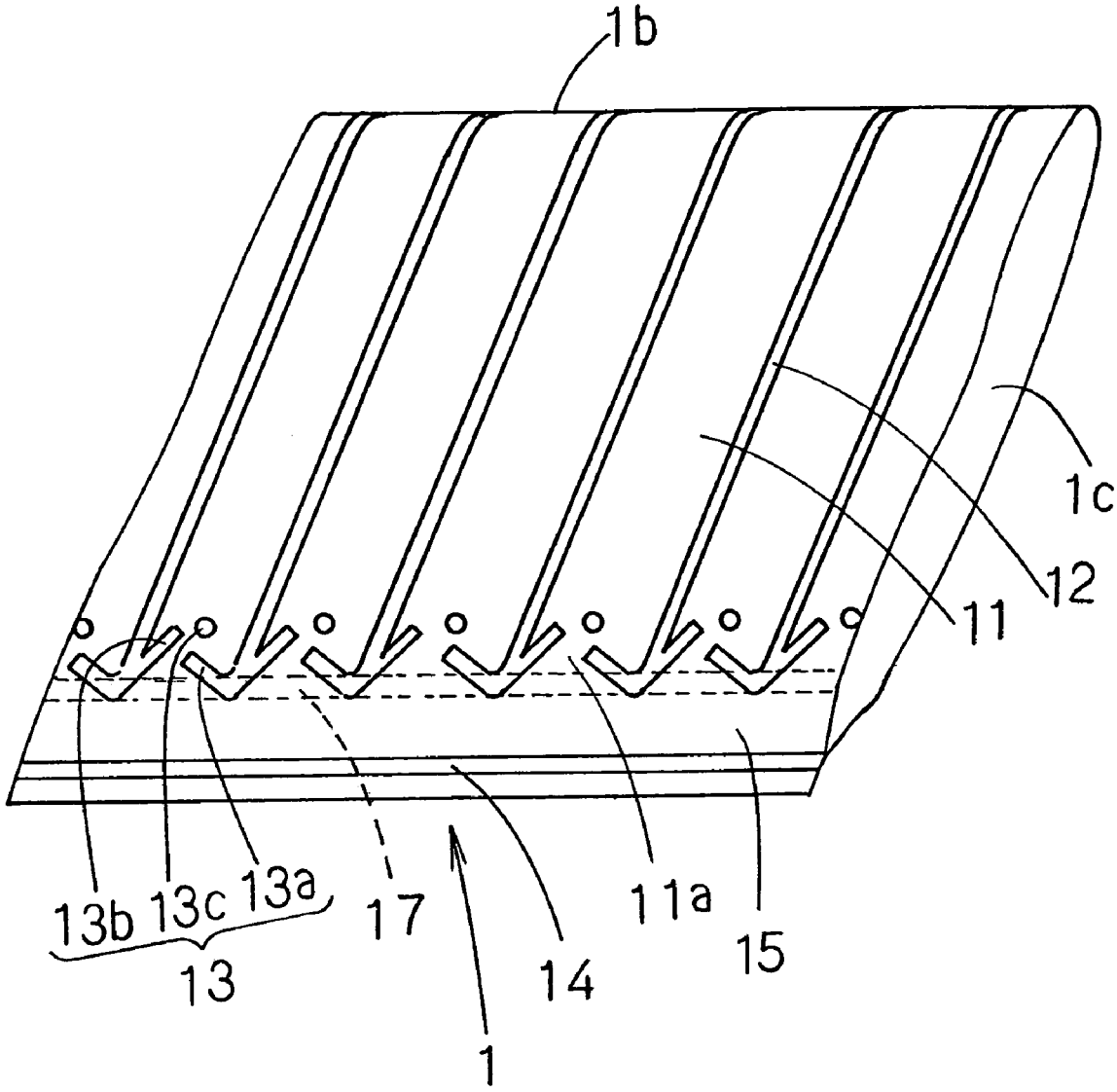
FIG. 5 is a perspective explanatory view showing a state where the cushioning sheet has been folded.

This sheet adhering unit 4 includes a longitudinal-direction seal section 41 and a width-direction seal section 42. The longitudinal-direction seal section 41 is disposed on the downstream side of the reverse folding means 33. This longitudinal-direction seal section 41 is to provide a longitudinal direction seal 14 along the longitudinal direction at the unclosed end side of the U-shaped cushioning sheet 1, as shown in FIG. 4(B), whereby the cushioning sheet 1 is formed to envelop the article storage space 1*c*, as shown in FIG. 5. Along with forming the longitudinal direction seal 14, an air passage 15 is formed between the longitudinal direction seal 14 and the bottom seals 12 which have been already formed on the cushioning sheet 1.

The width-direction seal section 42 disposed above a moving body M, which is described later, is to provide a width direction seal 16 in the width direction of the cushioning sheet 1 in order to close the article storage space 1*c* and the air passage 15.

In the present example, first, a width direction seal 16 for receiving the article C is formed on the end portion of the width side of the cushioning sheet 1, as shown in FIG. 2. When the width direction seal 16 is formed, the upstream side of the article storage space 1*c* is unclosed, and this portion becomes an opening 1*d* for storing an article which serves as an inlet of the article storage space 1*c*. After the article C has been put in the article storage space 1*c* through the opening 1*d*, the width direction seal 16 is also formed at the opening 1*d*, thus the article storage space 1*c* is closed.

Seals 14, 16 formed in respective directions are not limited to heat-sealing in this example, and sealing method may be changeable such as adhesives and the like. The sealing method can change the configuration of the seal.

Although the seal is provided in a continuous line in this example, a configuration of the seal may be formed with not only a continual dotted line but with a broken line so as to be able to let air flow to communicate inside and outside the article storage space 1*c*.

The article disposing unit 5 comprising a chuck section 51, a movable arm 52 and drive cylinders 53*a*, 53*b* as shown in FIGS. 6 to 8, is disposed above the reverse folding means 33, as represented by a dotted line in FIG. 2.

Each section of the article disposing unit 5 is driven by air pressure, with the movable arm 52 and the drive cylinders 53*a*, 53*b* being coupled together. Thus, the movable arm can be moved. At a lower end of the movable arm 52 is disposed the chuck section 51 in order to grip the article C. For this reason, the chuck section is moved up, down, left and right.

Although the article disposing unit 5 in the present example employs the drive cylinders 53*a*, 53*b*, the present invention is not limited thereto and can employ alternative drive units. When employing a servomotor, for example, the article C can be disposed in the article storage space 1*c* even the configuration of the article C has changed.

Here, a process for disposing the article C, which is at the side of the reverse folding means 33, will be explained while making reference to FIG. 2. First, the article C is held by the chuck section 51 and moved up by a vertical direction drive cylinder 53*a* (operation イ: a first Japanese letter in order equivalent to A). Then, a horizontal direction drive cylinder 53*b* moves the article right and position it right above the article storage space 1*c* (operation ロ: a second Japanese letter in order equivalent to B). Then, the movable arm 52, being moved downward by the vertical direction drive cylinder 53*a*, transfers the article C down to the inside of the article storage space 1*c* and puts it next to the width direction seal 16 which is pre-formed at the end of the downstream side of the cushioning sheet 11 (operation ハ: a third Japanese letter in order equivalent to C), and the chuck section 51 spreads to release the article C. Thereafter, the chuck section 51 performs a reverse movement and returns to where it starts operating.

By repeating the above-described operation, an article C to be packed is disposed in the article storage space 1*c* in succession.

As for the air-filling unit 6 in the present embodiment, a pipe nozzle 61 is disposed inside the air passage 15 of the cushioning sheet 1 as shown in FIG. 2. The nozzle 61 extends right and curves downward at a position that is further upstream than the longitudinal direction seal section 41, and a base end thereof is fixed to the manufacturing apparatus.

The air supplied from an air-supplying unit (not shown) such as a compressor is discharged through the nozzle 61 from an air discharge portion 61*a*, which is a tip of the nozzle.

Also, in the present embodiment, an adjusting nozzle 63 that shapes same as the nozzle 61 is disposed parallel to the nozzle 61. A tip of the adjusting nozzle 63 is disposed in the article storage space 1*c* of the cushioning sheet 1.

Here, description will be given of the procedure by which the small sacs 11 are filled with air and the cushioning package containing the packaged article is completed with respect to the cushioning sheet 1 of the state where the article C is disposed in the article storage space 1*c* as described above.

The manufacturing apparatus of the present embodiment is provided with a moving body M that is vertically movable along the longitudinal direction of the cushioning sheet 1. The moving body M comprises the width-direction seal section 42, an anti-reverse flow member 62 for holding the cushioning sheet 1 in the width direction, and a cutter 7 for cutting the cushioning sheet 1. Also, a small sac closing seal section 43 is disposed below the moving body M for closing the small sac inlet portions 11*a* by heat-sealing.

Figure 9:
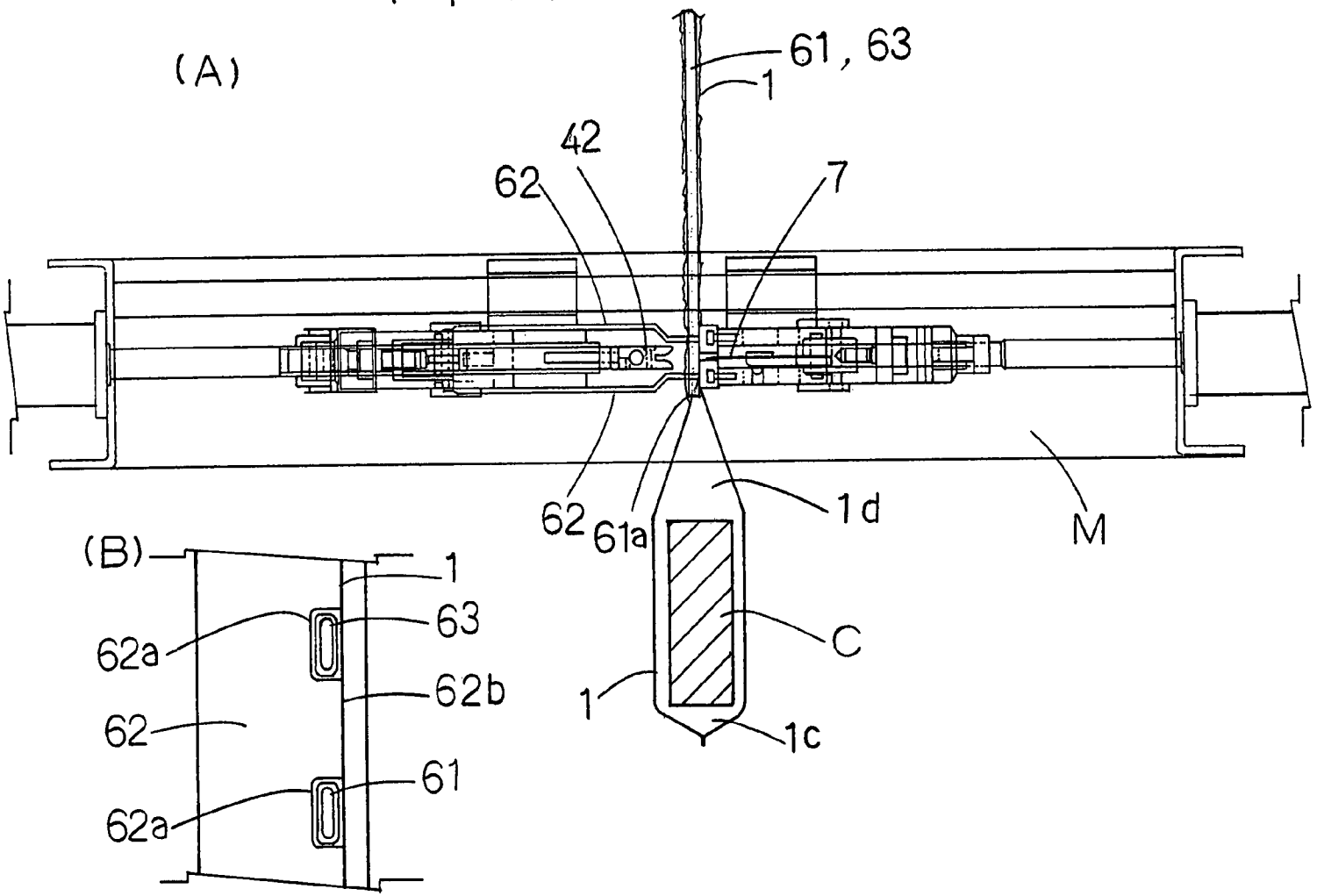
FIG. 9(A) is a major part explanatory view showing a state where the cushioning sheet is filled with air in the manufacturing apparatus according to an example of the embodiment of the present invention.
FIG. 9(B) is an explanatory view showing a reverse-flow prevention member.

As shown in FIG. 9(A), the cushioning sheet 1 with the article C disposed in the article storage space 1*c* is supplied with air which is discharged from the air discharge portion 61*a* of the nozzle 61 disposed in the air passage 15, and the air is filled in the small sacs 11 through the air passage 15. At this moment, the anti-reverse flow member 62 is disposed in somewhat further upstream position than the air discharge portion 61*a* of the nozzle 61, holding the cushioning sheet 1. This anti-reverse flow member is a plate member where recesses 62*a*, 62*a* of substantially rectangular or half-oval shape in cross-sectional view as shown in FIG. 9(B) are formed to recess a part of the planar tip 62*b* in the end of the member, and the nozzle 61 and the adjusting nozzle 63 are disposed at the recesses 62*a*, 62*a*. Here, with regard to the nozzle 61, the tip 62*b* presses the air passage 15 of the cushioning sheet 1, whereby the air supplied from the nozzle 61 as described above is prevented from leak and reverse flow in the upstream direction. So is the adjusting nozzle 63.

Here, it is preferable that the nozzle 61, the adjusting nozzle 63 and the shape of the recesses 62*a* have a structure that does not wrinkle the cushioning sheet 1 when the anti-reverse flow member 62 holds the sheet 1. For example, a dimension of the anti-reverse flow member 62 crossing the longitudinal direction makes as short as possible.

As for the cushioning sheet 1 in the present invention, a check valve for preventing air leakage is not disposed at the small sacs 11 and only the resistance seals 13 for imparting resistance to the air flowing through the small sac inlet portions 11*a* are disposed. Because of that, even though the small sacs 11 are filled with air by the nozzle 61 as described above, the air flows back to the air passage 15, leaking from the small sacs 11 as it is. To overcome that, a small sac closing seal 17 represented by the dotted line in FIG. 5 is formed by the small sac closing seal section 43 to close the small sac inlet portions 11*a*. Thus, the small sacs 11 are completely sealed and the air filled therein does not leak, resulting in maintaining cushioning effect.

The small sac inlet portions 11*a* may be temporarily pinched by a jig such as a rubber roller or a pressing plate in order to prevent the air filled in the small sac 11 from leaking until the small sac inlet portions 11*a* are closed as described above.

Figure 10:
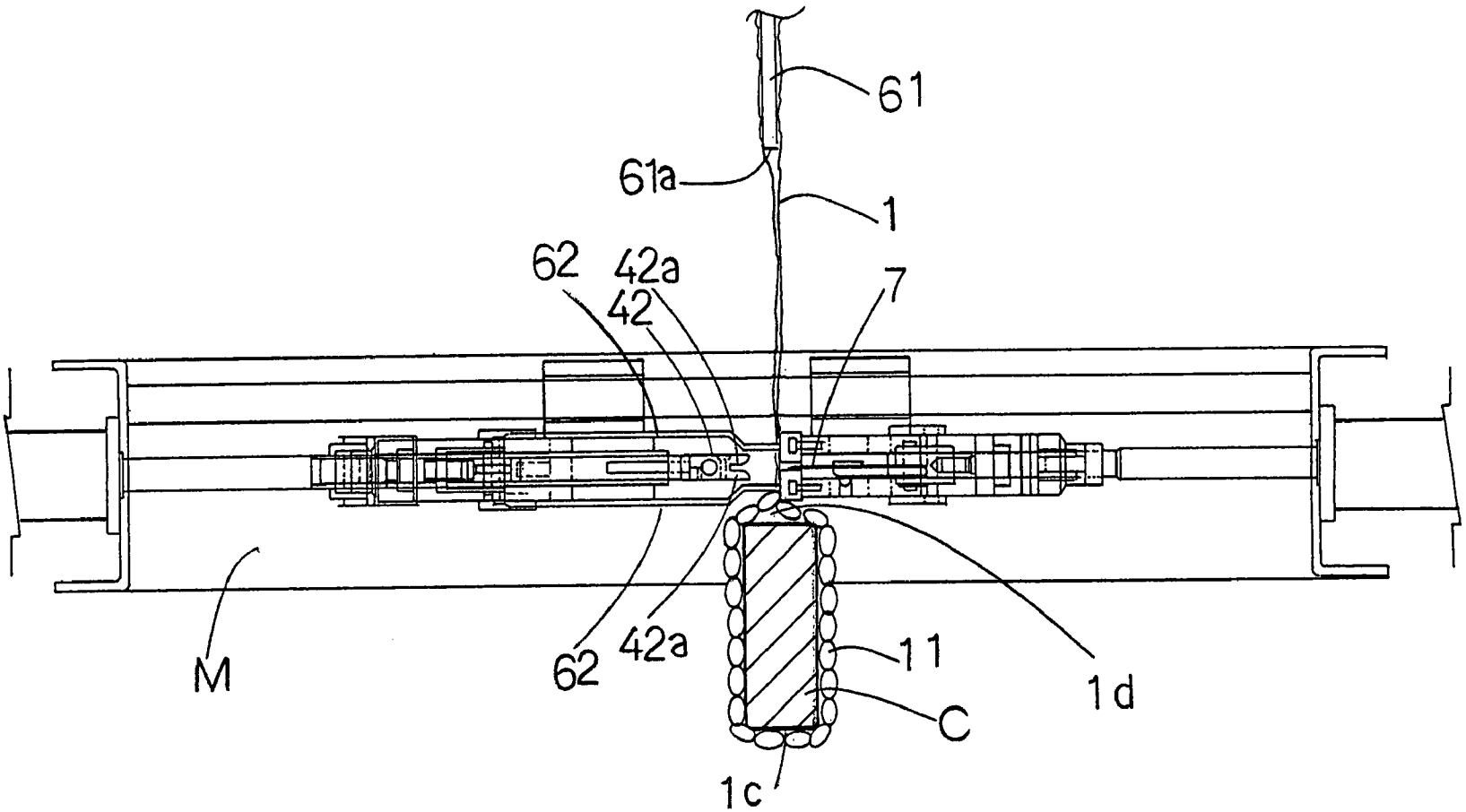
FIG. 10 is a major part explanatory view showing a state where a moving body is moved downward subsequent to filling of the cushioning sheet with air in the manufacturing apparatus.

Next, as shown in FIG. 10, the moving body M moves downward by a predetermined distance. Specifically, it moves by the length equivalent to making one portion of cushioning package containing an article. Since the anti-reverse flow member 62 still holds the cushioning sheet 1 as described above, the cushioning sheet 1 is also moved downward together with the movement of the moving body M. The sheet feeding adjustment unit 2 is operated in conjunction with this movement so that the cushioning sheet 1 is supplied from the cushioning sheet forming unit 8 by the length that the moving body M has moved.

The length that the moving body M moves is appropriately adjustable. Thus, a desirable cushioning package can be manufactured that matches the size of an article C to be packaged.

Then, in this state, the width-direction seal 16 is formed at the article storage opening 1*d* by the width-direction seal section 42 and closes the opening. In the width-direction seal section 42, seal bars 42*a*, being an edge portion of abutting against the cushioning sheet 1, are disposed parallel in two rows, whereby the width direction seals 16 are formed parallel in two rows on the sheet 1.

Figure 11:
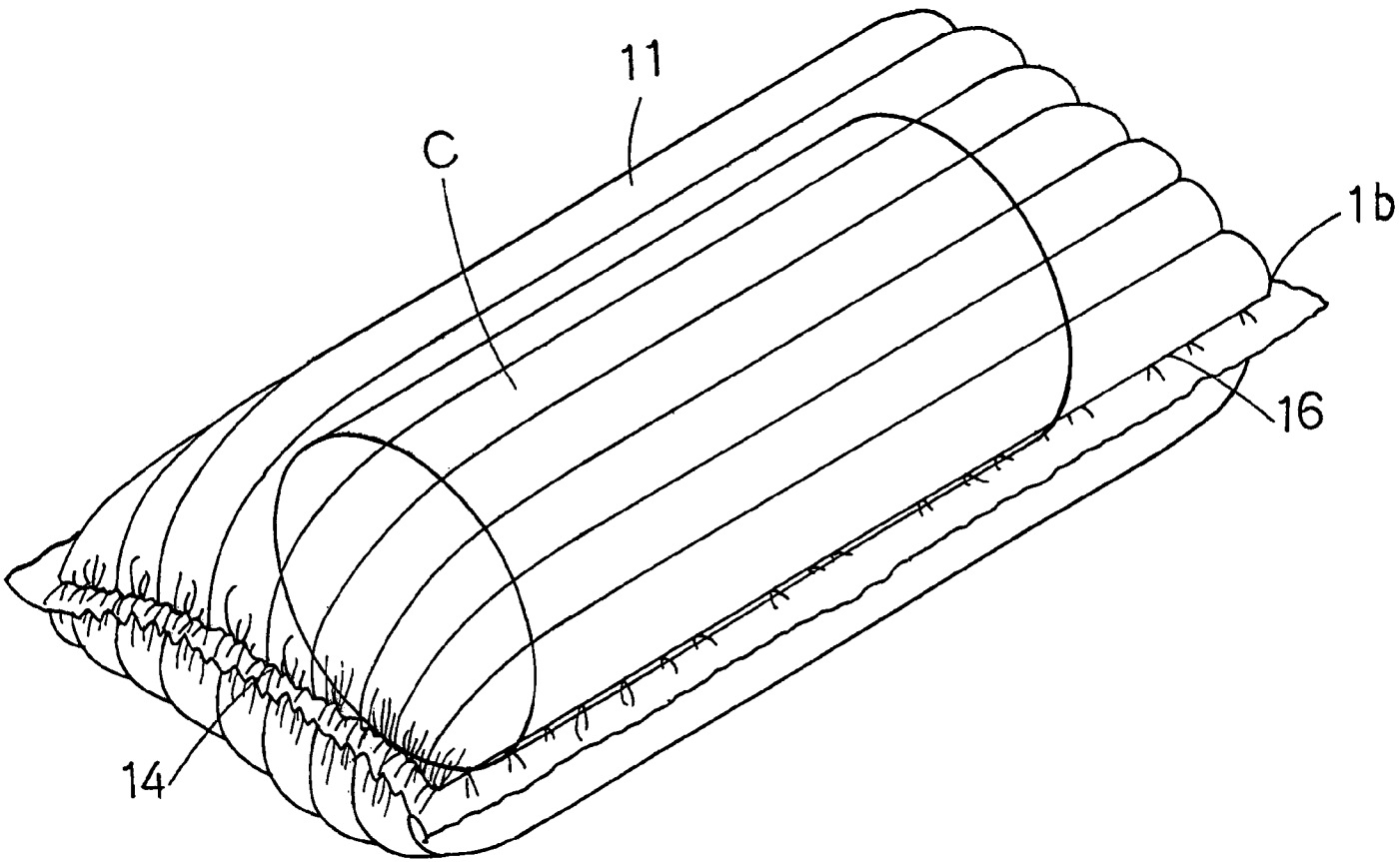
FIG. 11 is a perspective explanatory view showing an example of a cushioning package of the present invention which contains an article to be packaged.
Figure 12:
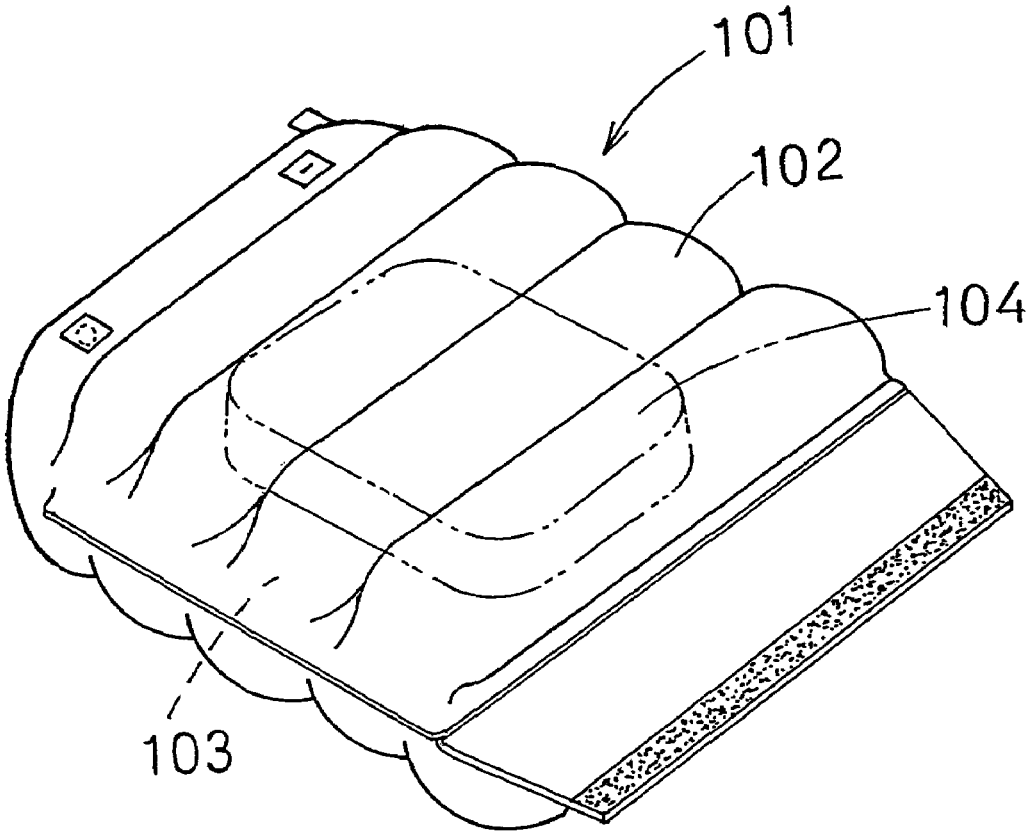
FIG. 12 is a perspective explanatory view showing an example of a conventional cushioning package containing an article to be packaged.

As the article storage opening 1*d* is closed by being formed with the width-direction seals 16, the cutter 7 cuts between the width-direction seals 16 disposed in two rows. Shown in FIG. 11, one portion of cushioning package containing an article to be packaged is completed while the small sacs 11 that have been filled with air envelops the article C to be packaged.

The manufacturing step comprising each of the aforementioned units is sequentially proceeded in the present invention, so a cushioning package containing an article to be packaged can be efficiently manufactured.

As the width-direction seal 16 is formed, the air passage 15 of the cushioning sheet 1 is also closed. Thus, the width-direction seals 16 can prevent the air filled in the small sacs 11 from leaking beyond the air passage 15 even without the above-described small sac closing seal 17. However, in a case where only the air passage 15 is closed in contrast to a case where the small sac closing seal 17 closes each small sac 11, once the width-direction seal 16 is torn and the article storage space 1*c* is opened, the air filled in the small sacs 11 leaks through the air passage 15. Also, since all the air leaks outside even one of the small sacs 11 is broken, use is limited to a disposable cushioning package and the like.

Here, the function of the adjusting nozzle 63 will be described.

Referring to filling of the small sacs 11 with air, when the air discharge portion 61*a* of the nozzle 61 discharges air while the cushioning sheet 1 is pressed by the above-described reverse-flow prevention member 62, the small sacs 11 are filled with the air and the inflated small sacs 11 as shown in FIG. 10 press the article storage space 1*c*. This is because the article storage space 1*c* in the present embodiment stays closed by the longitudinal direction seal 14, the fold 1*b*, the width direction seals 16 and the press of the reverse-flow prevention member 62. Owing to this, the small sac inlet portions 11*a* are pressed and the air flowing from the air passage 15 to the small sacs 11 stops, resulting in insufficient air-filling of the small sacs 11.

The internal pressure of the article storage space 1*c* is adjusted by sucking out the air inside the sealed article storage space 1*c* through the adjusting nozzle 63 disposed in the sealed article storage space 1*c*, which can prevent said insufficient air-filling.

As for different use of the adjusting nozzle 63, when the packaged article C can, for example, rust or deteriorate due to humidity or exposure of air, deaeration of the article storage space 1*c* is done via the adjusting nozzle 63 before filling an inert gas such as nitrogen gas into the article storage space 1*c* to preserve the product quality of the packaged article C.

Adoption of nylon, which excellently blocks air for the cushioning sheet 1 and tight closure of the article storage space 1*c* by sealing the cushioning sheet 1 with the heat seal 14, 16, prevents outflow of the inert gas from the inside and inflow of air from the outside, thus preserving the product quality of the packaged article C over a long period of time.

Dual cushioning effect can be achieved by filling the article storage space 1*c* with air from the adjusting nozzle 63 after the small sacs 11 have been already inflated to provide a cushioning effect to the article storage space 1*c* itself together with the small sacs 11. This may improve the cushioning effect of the entire cushioning package.

Thus, by adjusting the internal pressure of the article storage space 1*c* to a positive pressure or a negative pressure in comparison with the outside, a cushioning package that is best suited for the intended use can be made.

The embodiment of the present invention is not limited to the above-described embodiment and can be varied.

For example, instead of folding a single cushioning sheet 1 as in the present embodiment, all four sides of the opposing cushioning sheets 1 or three sides other than one longitudinal direction side or the two width direction sides of two opposing cushioning sheets 1 may be adhered to form the article storage space 1*c*. With all four sides adhered, a completely sealed cushioning package is formed. With three sides other than one longitudinal direction side adhered, a cushioning package having one opening is formed. With the two width direction sides adhered, a sleeve-type cushioning package is formed.

Also, instead of forming the article storage space 1*c* and then disposing the article C in the article storage space 1*c* as in the present embodiment, the article C may be disposed on the spread cushioning sheet 1 before the packaging and filling of the small sacs 11 with air.

When a cushioning package containing an article is formed by a series of steps as described above, the invention can be implemented by variously changing the procedure of the steps and the processing method within the scope of the present invention.

The present invention has the following excellent effects.

In the first aspect of the present invention, sequentially performed are a first step of forming a cushioning sheet including small sacs, a second step of forming an article storage space, a third step of disposing an article to be packaged in the article storage space and a fourth step of closing an article storage opening, achieving efficient manufacturing of a cushioning package containing an article to be packaged.

In the second aspect of the present invention, in addition to the effect of the first aspect, provision of resistance seal at the inlet portions of the small sacs produces resistance to airflow through the small sac inlet portions and avoids air leaking out of the small sacs in filling air, enabling the small sacs to be closed with the air filled inside.

In the third aspect of the present invention, an elongated flexible resin sheets pass a series of units, being processed into a cushioning package containing an article to be packaged, facilitating manufacturing of a cushioning package containing an article to be packaged.

In the fourth aspect of the present invention, in addition to the effect of the third aspect, the movement of the moving body including a width-direction seal section and reverse-flow prevention member assists in filling the small sacs with air, facilitating manufacturing of a cushioning package containing an article to be packaged.

In the fifth aspect of the present invention, in addition to the effect of the fourth aspect, press on an air passage by a tip of the reverse-flow prevention member ensures that the small sacs are filled with the air supplied from the air nozzle.

In the sixth aspect of the present invention, in addition the effects of the fourth or fifth aspect, an adjusting nozzle adjusts the internal pressure of the article storage space to a positive pressure or a negative pressure in comparison with the outside thereof, which can achieve prevention of insufficient air-filling of the small sacs, quality preservation of the packaged article and improvement of total cushioning effect of the cushioning package, achieving manufacturing of a cushioning package best suited for intended use.

What is claimed is:

1. A method of manufacturing a cushioning package containing an article to be packaged comprising:

a first step of forming a cushioning sheet by heat-sealing at least two flexible elongated sheets in a width direction, the elongated sheets being continuously fed in a longitudinal direction, the flexible elongated sheets having previously been placed one on another so as to overlap each other in a width direction of the sheets, the heat-sealing of the at least two flexible elongated sheets forming the cushioning sheet to include a plurality of small sacs in a uniform shape, each small sac having a length extending from one end to another in the width direction and having an air-filling inlet portion formed on at least one longitudinal end thereof;

a second step, following said first step, of forming an article storage space enveloped by the small sacs by folding the cushioning sheet substantially along a longitudinal centerline of the cushioning sheet and joining and adhering at least one longitudinal edge of the folded cushioning sheet;

adhering one side of the cushioning sheet in the width direction but not adhering an opposite side of the cushioning sheet in the width direction, thus forming the article storage space defined by the longitudinal edges of the cushioning sheet and the one adhered side of the cushioning sheet;

a third step of disposing an article to be packaged into the article storage space through an article storage opening that serves as an entry portion of the article storage space;

a fourth step of filling air to inflate the small sacs; and a fifth step of closing the article storage opening by adhesion of the cushioning sheet in a width direction on the side opposite to the one adhered side of the cushioning sheet in order to prevent the air filled in the small sacs from leaking and to simultaneously close the article storage opening, wherein the above steps are performed in the recited order.

2. The method of manufacturing a cushioning package containing an article to be packaged as in claim 1, wherein said first step includes forming a plurality of bottom seals in the width direction of the overlapped sheets, thereby forming the small sacs extending in the width direction of the sheet; and providing resistance seals for imparting resistance to the flowing air at the inlet portions of the small sacs; and wherein said second step includes forming an air passage between a longitudinal direction seal and the bottom seals.

3. The method of manufacturing a cushioning package containing an article to be packaged as in claim 1, wherein each of the small sacs extends around the article to be packaged.

4. The method of manufacturing a cushioning package containing an article to be packaged as in claim 1, wherein the second step includes forming a crease by folding the small sacs substantially at mid-sections of their lengths.

5. The method of manufacturing a cushioning package containing an article to be packaged as in claim 2, wherein the resistance seals include a circular seal and a linear seal, the linear seal being disposed at a slant to the adhered edges of the cushioning sheet.

6. A method of manufacturing a cushioning package containing an article to be packaged comprising:

a first step of forming a cushioning sheet by heat-sealing at least two flexible elongated sheets in a width direction, the elongated sheets being continuously fed in a longitudinal direction, the flexible elongated sheets having previously been placed one on another so as to overlap each other in a width direction of the sheets, the heat-sealing of the at least two flexible elongated sheets forming the cushioning sheet to include a plurality of small sacs in a uniform shape, each small sac having a length extending from one end to another in the width direction and having an air-filling inlet portion formed on at least one longitudinal end thereof;

a second step, following said first step, of forming an article storage space enveloped by the small sacs by folding the cushioning sheet substantially along a longitudinal centerline of the cushioning sheet and joining and adhering one longitudinal edge of the folded cushioning sheet;

adhering one side of the cushioning sheet in the width direction but not adhering an opposite side of the cushioning sheet in the width direction, thus forming the article storage space defined by the longitudinal edges of the cushioning sheet and the one adhered side of the cushioning sheet, an article storage opening remaining between the longitudinal edges of the cushioning sheet at the side opposite to the one adhered side of the cushioning sheet;

a third step of disposing an article to be packaged into the article storage space through the article storage opening that serves as an entry portion of the article storage space;

a fourth step of filling air through the article storage opening to inflate the small sacs; and a fifth step of closing the article storage opening by adhesion of the cushioning sheet in a width direction on the side opposite to the one adhered side of the cushioning sheet in order to prevent the air filled in the small sacs from leaking and to simultaneously close the article storage opening, wherein the above steps are performed in the recited order.

7. The method of manufacturing a cushioning package containing an article to be packaged as in claim 6, wherein said first step includes forming a plurality of bottom seals in the width direction of the overlapped sheets, thereby forming the small sacs extending in the width direction of the sheet; and providing resistance seals for imparting resistance to the flowing air at the inlet portions of the small sacs; and wherein said second step includes forming an air passage between a longitudinal direction seal and the bottom seals.

8. The method of manufacturing a cushioning package containing an article to be packaged as in claim 6, wherein each of the small sacs extends around the article to be packaged.

9. The method of manufacturing a cushioning package containing an article to be packaged as in claim 6, wherein the second step includes forming a crease by folding the small sacs substantially at mid-sections of their lengths.

10. The method of manufacturing a cushioning package containing an article to be packaged as in claim 7, wherein the resistance seals include a circular seal and a linear seal, the linear seal being disposed at a slant to the adhered edges of the cushioning sheet.

* * * * *